US005242502A

United States Patent [19]

Rowe

[11] Patent Number: 5,242,502

[45] Date of Patent: Sep. 7, 1993

[54] METHOD AND APPARATUS FOR CLEANING ARTICLES

[75] Inventor: Edward A. Rowe, Grand Island, N.Y.

[73] Assignee: Occidental Chemical Corporation, Niagara Falls, N.Y.

[21] Appl. No.: 892,292

[22] Filed: Jun. 2, 1992

[51] Int. Cl.[5] ..... B08B 3/08; B08B 7/04

[52] U.S. Cl. ..... 134/10; 134/11; 134/26; 134/30; 134/31; 134/40; 134/15; 252/162; 252/172; 252/DIG. 8

[58] Field of Search ..... 134/10, 11, 12, 26, 134/27, 30, 31, 38, 40, 41; 252/172, 162, DIG. 8

[56] References Cited

U.S. PATENT DOCUMENTS 4,038,276 7/1977 Geiger et al. ..... 260/248
4,231,805 11/1980 Petterson et al. ..... 134/11
4,289,586 9/1981 Sabatka ..... 134/12 X
4,426,311 1/1984 Vande Mey ..... 134/3 X
4,983,223 1/1991 Gessene ..... 134/25.4
5,059,451 10/1991 Agou et al. ..... 427/164

*Primary Examiner*—Theodore Morris
*Assistant Examiner*—Saeed F. Chaudhry
*Attorney, Agent, or Firm*—Wayne A. Jones; Richard D. Fuerle

[57] ABSTRACT

Disclosed is a method and degreasing apparatus for cleaning articles. The articles are contacted with a chlorinated benzotrifluoride liquid which is subsequently washed from the articles using liquid methylene chloride. The degreaser includes means for applying the liquids to the articles and can also include means for evaporating some of the methylene chloride to render vapors of the chlorinated benzotrifluoride nonflammable.

14 Claims, 2 Drawing Sheets

METHOD AND APPARATUS FOR CLEANING ARTICLES

BACKGROUND OF THE INVENTION

This invention relates to a method and apparatus for cleaning articles, particularly articles that have been buffed with a hydrocarbon wax. The method and apparatus involve contacting a soiled article with a liquid chlorinated benzotrifluoride compound at a temperature of about 70° to about 100° C., followed by washing the benzotrifluoride compound off the article with liquid methylene chloride.

In the metalworking industry, metal parts are commonly buffed to enhance their appearance. The buffing compound, or rouge, typically consists of various metal oxides dispersed in a waxy substance. To remove the buffing compound from the parts, the parts were usually cleaned in a vapor degreaser where they were contacted with vapors of 1,1,1-trichloroethane or trichloroethylene. Because these solvents boil at 74° and 86° C., respectively, they are ideal for melting and removing buffing compounds from the parts, yet they do not become so hot that they "set" the buffing compound or oxidize the metal surface (as perchloroethylene would, which boils at 121° C.).

However, 1,1,1-trichloroethane has been found to cause depletion of ozone in the stratosphere and its use in degreasers has now been made illegal. Trichloroethylene is also outlawed in many states as it is a photochemical oxidant. At the present time no good substitutes have been found to replace these two solvents.

SUMMARY OF THE INVENTION

I have discovered that articles can be effectively cleaned with a liquid chlorinated benzotrifluoride compound followed by washing the liquid chlorinated benzotrifluoride compound off the article with liquid methylene chloride. While the prior process for cleaning articles involved the use of a single vaporized solvent, the process of this invention involves the use of a first liquid to do the cleaning, followed by a second liquid to remove the first liquid. Unlike the previously used degreasing solvents, regulations do permit the use of the solvents of this invention for cleaning purposes.

The process of this invention offers a number of advantages over the prior cleaning process. For example, while the prior process heated the parts to 74° C., the boiling point of 1,1,1-trichloroethane, the parts leave the process of this invention at a temperature of only 40° C., the boiling point of methylene chloride. Thus, it is not necessary to cool the parts and they can be handled directly.

I have found that existing degreasing machines can be easily retrofitted to accommodate the cleaning process of this invention. In addition, it is possible to adjust the temperature of the benzotrifluoride compound to the optimal temperature for cleaning any particular article.

In one embodiment of this invention, a portion of the methylene chloride is vaporized to provide a vapor around the benzotrifluoride liquid, thus rendering the combined benzotrifluoride and methylene chloride vapors nonflammable. The combined vapors are then condensed for recovery; the condensed liquids are easily separable because their boiling points are widely separated (40° C. for methylene chloride, 139° C. for parachlorobenzotrifluirde (PCBTF), and 173° C. for 3,4-dichlorobenzotrifluoride (DCBTF)). Because the two liquids have low heats of vaporization (142 BTU/lb for methylene chloride and about 100 BTU/lb for the benzotrifluoride compound), distillation does not require the expenditure of a great deal of energy.

BRIEF DESCRIPTION OF THE DRAWING

FIG. I is a diagrammatic view showing a vapor degreaser for performing the process of this invention, where the articles are cleaned one at a time.

FIG. II is a diagram illustrating an automatic degreasing machine for performing the process of this invention, where articles to be cleaned continuously pass through the machine on a conveyor.

Figure 1:
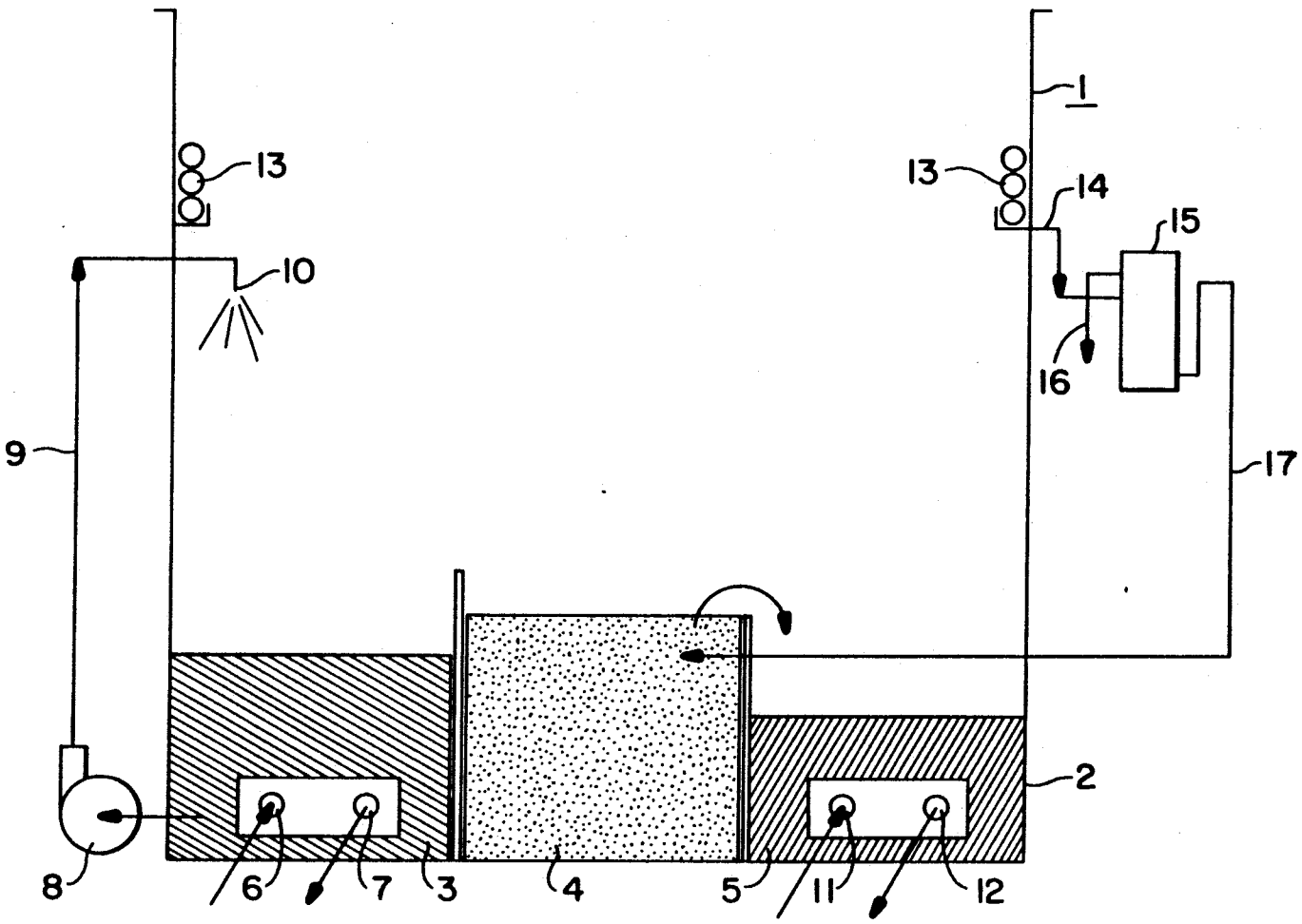
Figure 2:
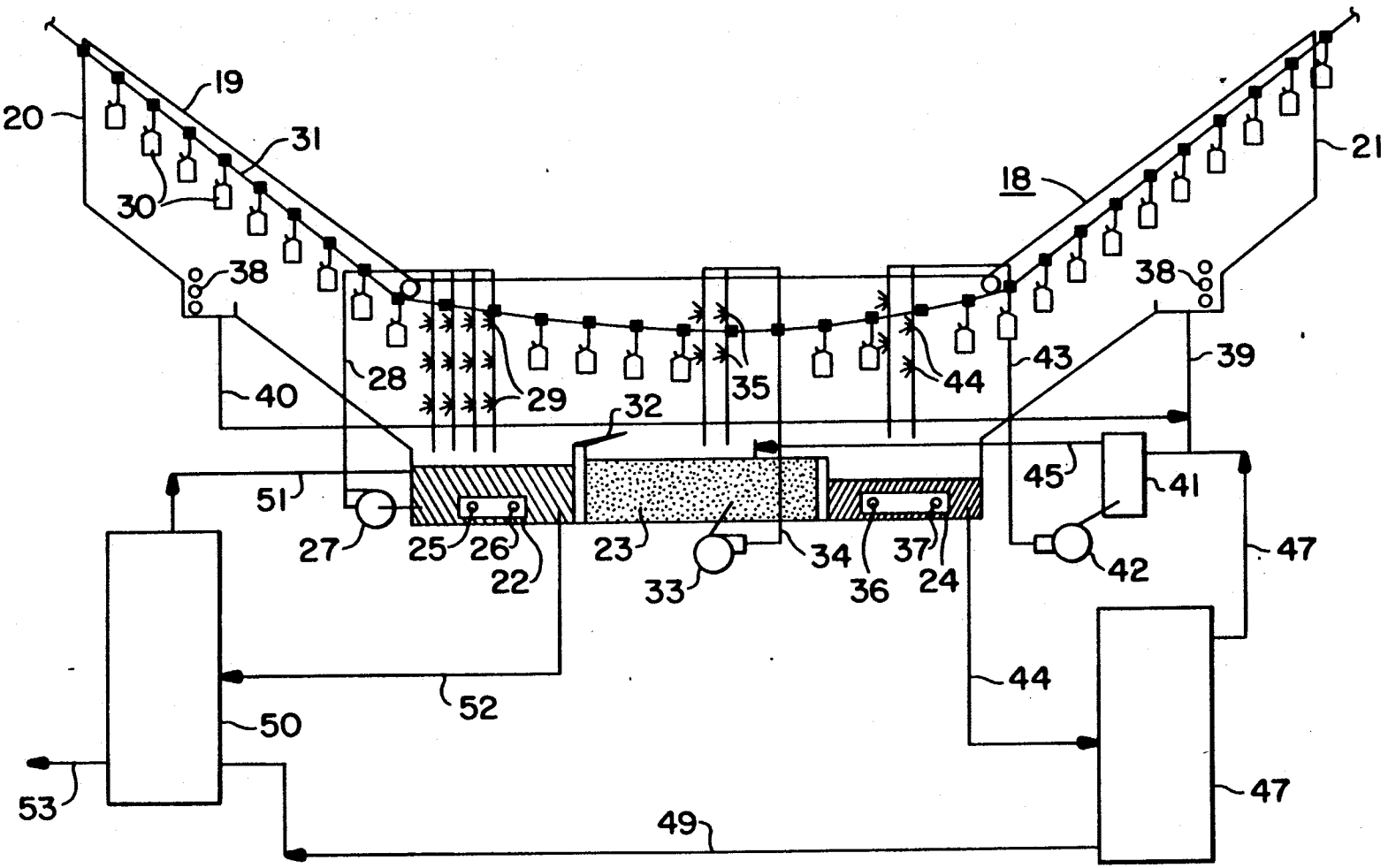

In FIG. I, degreasing apparatus 1 consists of a large container 2 in which are three smaller tanks, 3, 4, and 5. In tank 3 is placed the chlorinated benzotrifluoride liquid according to this invention. The liquid in tank 3 can be heated by, for example, steam pipes 6 and 7. (Electrical or other means of heating could also be used.) While articles to be cleaned can be dipped into this tank, the liquid from tank 3 can also be pumped by pump 8 through line 9 and out sprayer 10 onto the article.

Tank 4 contains liquid methylene chloride. After the articles have been contacted with the chlorinated benzotrifluoride compound, the articles are dipped into tank 4 where the methylene chloride washes the chlorinated benzotrifluoride compound off the articles. Overflow from tank 4 passes into tank 5. Tank 5 also contains methylene chloride, which can be heated by steam pipes 11 and 12 to its boiling point, 104° C., to vaporize it and provide a methylene chloride vapor over the chlorinated benzotrifluoride liquid and thereby render the chlorinated benzotrifluoride vapors nonflammable. The combined chlorinated benzotrifluoride and methylene chloride vapors are condensed by coils 13 which, typically, contain water chilled to less than 15° C. The condensed vapors pass through line 14 into water separator 15 where any condensed water is decanted off through line 16. The condensed organic liquids are then returned through line 17 to tank 4. Periodically, it is necessary to remove solids from the bottom of the tanks and purify the methylene chloride, which can be done by distillation.

In FIG. II, degreasing machine 18 consists of an enclosed passageway 19 having an open entrance 20 and an open exit 21. Inside passageway 19, at the center, are three tanks, 22, 23, and 24. Tank 22 contains a liquid chlorinated benzotrifluoride compound according to this invention. Steam pipes 25 and 26 heat the liquid chlorinated benzotrifluoride compound to the desired temperature for cleaning the articles. A pump, 27, pumps the liquid benzotrifluoride compound through line 28 and out spray nozzles 29 onto articles 30 that pass through the degreaser on conveyor 31, entering through entrance 20 and leaving through exit 21. Liquid benzotrifluoride compound that drips from the articles strikes splash pan 32 and flows back into tank 22.

Tank 23 contains liquid methylene chloride, which is pumped by pump 33 through line 34 and out nozzles 35 onto articles 30 to be cleaned, washing the liquid benzotrifluoride compound off articles 30 and down into tank 23. In tank 24, methylene chloride is vaporized by steam pipes 36 and 37 to provide methylene chloride vapor within degreasing machine 18 in order to make the vapors of chlorinated benzotrifluoride compound nonflammable. The combined vapors are condensed by coils 38, typically containing cold water, and the condensed vapors flow through lines 39 and 40 into tank 41. From tank 41 the condensed vapors can be pumped by pump 42 through line 43 and out nozzles 44 to provide additional methylene chloride rinsing of the articles. Overflow from tank 41 passes through line 45 back to tank 23. The methylene chloride in tank 23 overflows into tank 24 and methylene chloride from tank 24 is removed through line 44 to methylene chloride still 47, which separates the methylene chloride from the chlorinated benzotrifluoride compound. (While the methylene chloride and benzotrifluoride compounds are miscible, they do not form an azeotrope.) The methylene chloride from still 47 passes through line 48 back to tank 41 and the chlorinated benzotrifluoride compound passes from methylene chloride still 47 back through line 49 to benzotrifluoride still 50. Distilled benzotrifluoride compound passes from benzotrifluoride still 50 through line 51 into one end of tank 22, and less pure benzotrifluoride compound in tank 22 passes through line 52 back to benzotrifluoride still 50. Waste products in the benzotrifluoride liquid can be removed from benzotrifluoride still 50 through line 53.

Almost any type of small part can be cleaned with the method and apparatus of this invention. Examples of typical parts include lipstick cases, watchbands, jewelry, pens, and small plated metal articles. The parts are typically contaminated with a buffing compound, usually a hydrocarbon wax, that is soluble in the benzotrifluoride compound. However, articles that contain nonsoluble contaminants can also be cleaned using the process and apparatus of this invention. For example, the article can be heated with the benzotrifluoride solvent to a temperature above the boiling point of the methylene chloride and, when the article is dipped in, or sprayed with, the methylene chloride, the methylene chloride will boil on the surface of the article and blast the soil off.

The benzotrifluoride compounds of this invention have the formula

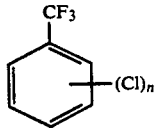

where n is 1, 2, or 3. The preferred benzotrifluoride compound is PCBTF or DCBTF as those compounds are commercially available. The other isomers are known to those skilled in the art. The benzotrifluoride compound should be pure and should not contain contaminants that may attack the equipment. How much benzotrifluoride compound should be used depends upon the size of the part to be cleaned, the amount of soil on the article, and the solubility of the soil. The benzotrifluoride compound should be heated to about 70° to about 100° C., and preferably to about 75° to about 90° C.; lower temperatures do not clean well, and higher temperatures may cause corrosion problems.

Because the vapors of the benzotrifluoride compound are-flammable, it is preferable to mix them with methylene chloride vapors to exclude enough oxygen to create a nonflammable vapor mixture above the benzotrifluoride compound. The mixed vapors can then be condensed to provide a soil-free methylene chloride for final rinsing of the articles. Sufficient methylene chloride should be vaporized not only for nonflammability, but also to provide enough condensate for rinsing the articles.

It is preferable to use methylene chloride that has been stabilized. For example, about 0.5 wt % propylene oxide can be added to the methylene chloride to act as an acid acceptor, reacting with hydrochloric acid to prevent the corrosion of equipment. About 65 ppm (by weight) of cyclohexene can be added to the methylene chloride to prevent its oxidation to formyl chloride and then to formic acid, which can release hydrochloric acid. Diisopropyl amine in an amount of about 25 ppm (wt) can be added to control the pH, which should be kept above 7 but, in order to prevent the corrosion of copper-containing metals, should not be too high. Mixed amylenes can be added to act as high-temperature stabilizers to prevent oil on the parts from alkylating to form carbon; about 0.3 wt % can be used. Preferably, a mixture of different stabilizers is used; methylene chloride can be purchased as a commercial product that already contains a mixture of stabilizers (e.g., "M-Clene D" from Occidental Chemical Corp.). See, for example, U.S. Pat. Nos. 3,900,524, 3,923,912, 3,860,665, 3,968,250, 3,864,408, 3,887,628, and 3,898,195, herein incorporated by reference, for additional information on methylene chloride stabilizers.

The following examples further illustrate this invention.

EXAMPLE

Using ASTM Test D1545-89, the solubility of various waxes and resins in 25° C. PCBTF and DCBTF was determined. The kinematic viscosity (in centipoises) was also determined at the solubility limit. The following table gives the wt % solubility (the number in parenthesis is the viscosity).

| | PCBTF | DCBTF |
|---|---|---|
| Paraffin Wax (60° C. melt point) | <5 | <5 |
| Paraffin Wax (at 60° C.) | >70 | >70 |
| AMOCO INDOPOL H100 (Polybutenes) | >70 | >70 |
| Durez Resin 29095 (Phenolic) | 53 (1332) | 45 (154) |
| Goodyear Wingtack Extra (Polyterpene Hydrocarbon) | 58 (384) | 53 (373) |
| Goodyear Vitel PE 200 (Phthalate Ester) | 31 (9948) | 25 (12580) |
| Goodyear Vitel PE 307 (Phthalate Ester) | 34 (8617) | 26 (4422) |
| Hercules Staybelite Ester 10 (Hydrogenated Rosin Glyceride) | 60 (502) | 55 (221) |
| Monsanto Gelva GMS 788 (Acrylate Copolymers In Solvent) | >70 | >70 |
| Shell Krayton D 1107P (Styrene Rubber Block Polymers) | 32 (31900) | 31 (59249) |

The table shows that PCBTF and DCBTF are good solvents for the wax and a variety of resins.

I claim:

1. A method of cleaning an article comprising (A) heating a chlorinated benzotrifluoride liquid having the formula

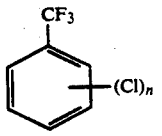

where n is 1, 2, or 3, to a temperature of about 70° to about 100° C.;

(B) contacting said article with said heated chlorinated benzotrifluoride liquid; and (C) washing said chlorinated benzotrifluoride liquid off said article with liquid methylene chloride.

2. A method according to claim 1 wherein said chlorinated benzotrifluoride liquid is 3,4-dichlorobenzotrifluoride.

3. A method according to claim 1 wherein said chlorinated benzotrifluoride liquid is parachlorobenzotrifluoride.

4. A method according to claim 1 wherein said chlorinated benzotrifluoride liquid is heated to a temperature of about 75° to about 90° C.

5. A method according to claim 1 including the additional step of vaporizing methylene chloride and passing the methylene chloride vapors formed over said chlorinated benzotrifluoride liquid.

6. A method according to claim 5 including the additional steps of condensing the vapors over said chlorinated benzotrifluoride liquid, separating methylene chloride in the condensate from chlorinated benzotrifluoride liquid in the condensate, and recycling the condensed methylene chloride to step (C) and the condensed chlorinated benzotrifluoride liquid to step (A).

7. A method according to claim 1 wherein said chlorinated benzotrifluoride liquid is sprayed onto said article.

8. A method according to claim 1 wherein said article is immersed into said chlorinated benzotrifluoride liquid.

9. A method according to claim 1 wherein said article is soiled with a buffing compound.

10. A method according to claim 1 wherein said methylene chloride contains about 0.5 wt % propylene oxide.

11. A method according to claim 1 wherein said methylene chloride contains about 65 ppm cyclohexene.

12. A method according to claim 1 wherein said methylene chloride contains about 25 ppm diisopropyl amine.

13. A method according to claim 1 wherein said methylene chloride contains about 0.3 wt % mixed amylenes.

14. A method according to claim 1 including the additional initial step of attaching said article to a conveyor.

* * * * *